United States Patent [19]

Wackerle et al.

[11] Patent Number: 5,042,395

[45] Date of Patent: Aug. 27, 1991

[54] COMPOSITE VEHICLE BODY HAVING SANDWICH PANELS INTEGRALLY FORMED WITH FRAME PARTS TO FORM INDIVIDUAL BODY MODULES WHICH ARE CONNECTED TO OTHER BODY MODULES TO FORM THE VEHICLE BODY

[75] Inventors: Peter M. Wackerle, Assling; Franz Sperber, Kolbermoor; Josef Gröber, Putzbrunn, all of Fed. Rep. of Germany

[73] Assignee: Messerschmitt-Bölkow-Blohm GmbH, Münich, Fed. Rep. of Germany

[21] Appl. No.: 434,272

[22] Filed: Nov. 13, 1989

[30] Foreign Application Priority Data

Nov. 15, 1988 [DE] Fed. Rep. of Germany ..... 3838686

[51] Int. Cl.[5] ..... B61D 17/00; B61D 17/04

[52] U.S. Cl. ..... 105/397; 105/401; 52/282; 296/191; 296/197; 296/901

[58] Field of Search ..... 105/329.1, 397, 401, 105/409, 423; 52/282, 309.11; 296/191, 197, 901

[56] References Cited

U.S. PATENT DOCUMENTS

| | | | |
|---|---|---|---|
| 2,744,042 | 5/1950 | Pace | 105/423 |
| 2,934,372 | 4/1960 | Jewell et al. | 52/282 |
| 3,100,458 | 8/1963 | Baker et al. | 105/397 |
| 3,637,252 | 1/1972 | Metsker | 52/309.11 |
| 4,068,434 | 1/1978 | Day et al. | 52/309.11 |
| 4,221,426 | 9/1980 | Wardill | 105/397 |
| 4,283,063 | 8/1981 | Morin | 296/197 X |
| 4,662,138 | 5/1987 | Bryant | 52/282 |
| 4,777,774 | 10/1988 | Smalley | 52/282 |

*Primary Examiner*—Robert J. Oberleitner
*Assistant Examiner*—S. Joseph Morano
*Attorney, Agent, or Firm*—Kenyon & Kenyon

[57] ABSTRACT

A rail vehicle body consisting of a support frame and sandwich parts attached thereto having an outer and an inner cover layer and supporting layer glued in between them, comprises, with a view to cost-effective fabrication and above all reduction of assembly cost, individually made body modules which are designed in integral construction as a sandwich structure with support frame parts inserted in the region of the supporting layer and fastened to the cover layers and being provided at the edges of the support frame parts with fitting connections for assembly of the body modules.

13 Claims, 4 Drawing Sheets

Fig. 5
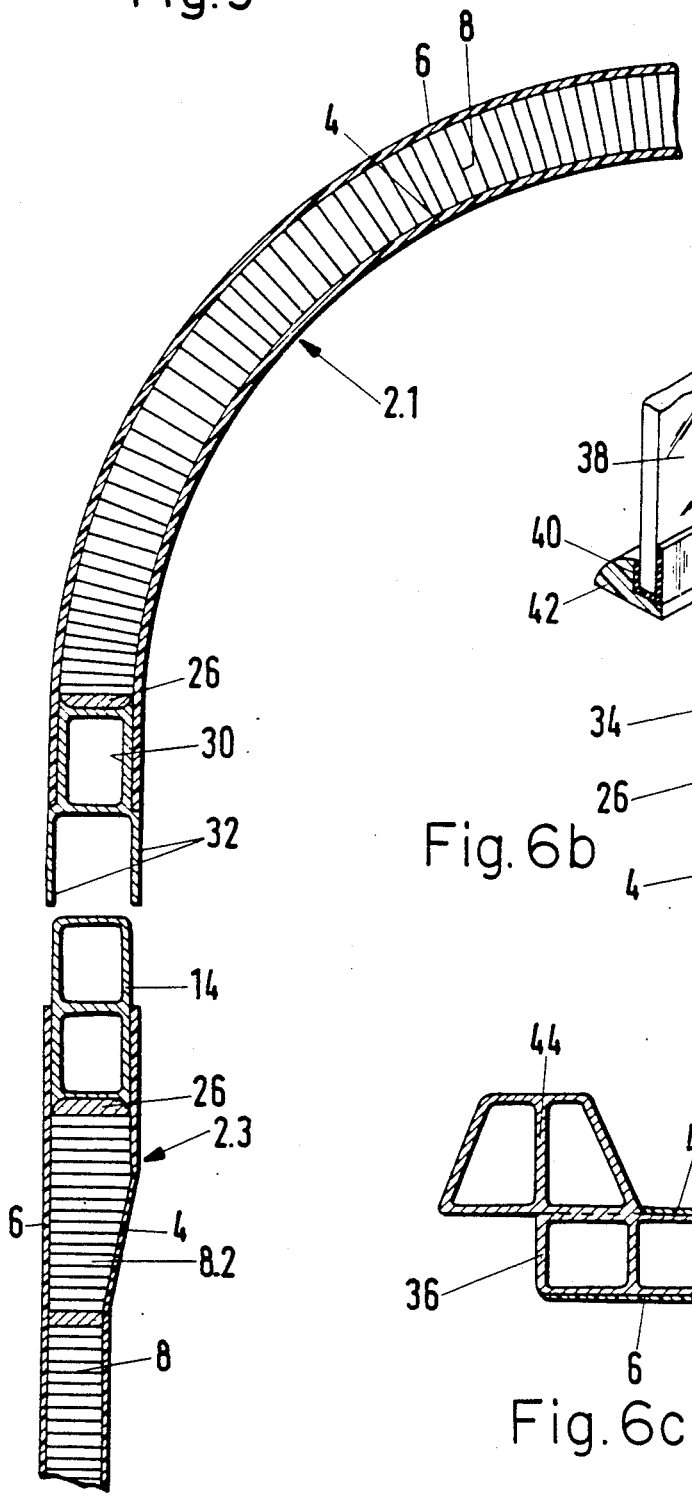
Fig. 6a
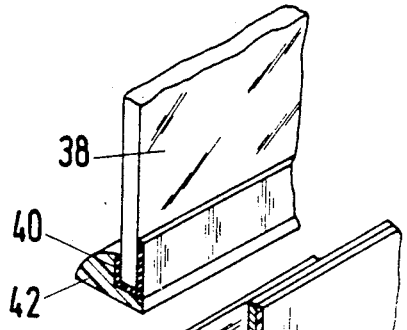
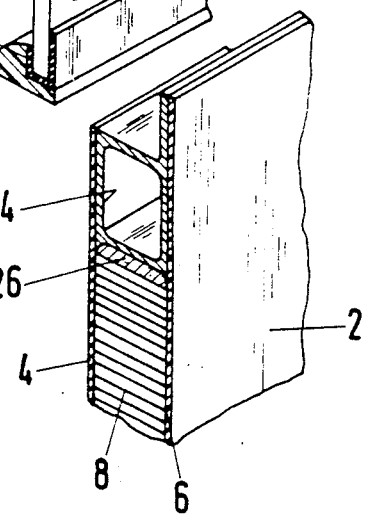
Fig. 6b
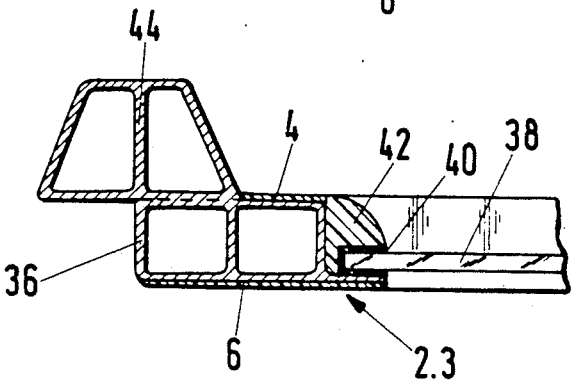
Fig. 6c

COMPOSITE VEHICLE BODY HAVING SANDWICH PANELS INTEGRALLY FORMED WITH FRAME PARTS TO FORM INDIVIDUAL BODY MODULES WHICH ARE CONNECTED TO OTHER BODY MODULES TO FORM THE VEHICLE BODY

BACKGROUND OF THE INVENTION

The present invention relates to a vehicle body, in particular for a rail vehicle.

In the manufacture of such vehicle bodies of known construction, first the complete support frame is constructed usually by welding together the individual frame parts including the window and door frames—and thereafter the sandwich parts forming the outer skin and optionally also an additional inner sheeting are applied to the unfinished body thus fabricated. Such a procedure adversely affects the manufacturing costs inasmuch as, for one thing, expensive production means, e.g. a costly assembly rig, must be made available for the construction of the support structure, and secondly the subsequent planking of the support structure with the outer and inner cover parts is a labor—and hence cost-intensive process.

SUMMARY OF THE INVENTION

It is an object of the present invention to provide a vehicle body of the initially mentioned kind so that it can be produced with simple fabrication means and at low labor cost.

The above and other objects of the invention are achieved by a vehicle body, in particular for a rail vehicle, comprising of a support frame and sandwich parts attached thereto which contain respectively an outer and an inner cover layer and a support layer cemented between them, the vehicle body comprising individually fabricated body modules which are formed in integral construction as a sandwich structure with support frame parts inserted in the region of the support layer and secured to the cover layers and are provided at the edges of the support frame parts with fitting connections for fitting the body modules together.

According to the invention, the support frame parts are incorporated as integral parts in the respective sandwich structures already before assembly of the body and are fixed there together with the precisely fitting connecting elements disposed at the frame parts, exactly and securely in their final assembly position, so that it is no longer necessary to assemble the inner support frame and the sandwich planking of the body in separate, expensive manufacturing steps, with the aid of a bulky assembly rig. Instead, the invention-specific body modules, optionally already provided with an inner lining, can be fabricated separate from the ultimate site of installation in an extremely rational manner by means of simple, flat, or at most simply curved forming and bonding devices and then assembled to the finished vehicle body quickly and easily by fitting their connecting elements together, resulting in a very considerable reduction of the cost of fabrication means and labor.

A preferred embodiment of the invention with respect to easy fitting together of the individual body modules comprises in that the fitting connections consist of plug-in connecting elements which after being plugged together, are coupled to each other for transmission of load, and preferably, glued together.

The individual body modules may be completely enclosed, appropriately at the edges, by support frame parts equipped with fitting connections, whereby there results a coupling of the support frame in the region of the fitting connections which is very uniform over the entire outer periphery of the body modules and hence highly resistant to load, and at the same time a neat edge finish for the individual sandwich structures is obtained in a simple manner.

With a view to a structurally very simple design of the fitting and plug-in connections combined with a low dead weight of the support frame structure, the support frame parts are designed preferably as hollow sections to be telescoped with precise fit in the edge region of the body modules.

For reasons of greater structural strength and especially also to facilitate the exact mutual positioning of the respective support frame parts during fabrication of the individual body modules, the support frame parts are preferably joined together within the individual body modules, preferably in grid fashion, and this preferably by easily assembled expansion bolt units.

A further simplification in terms of fabrication may be achieved in that the support layer sections are fitted between the frame parts of the respective body modules via an equalizing adhesive, so that an exact cut of these support layer sections can be dispensed with in the fabrication of the body modules, the support layer sections consisting preferably of a honeycomb core or foam material which in the manufacture of curved body modules adapts itself elastically to the required curvature very simply and at no great cost of deformation.

According to a further, especially preferred aspect of the invention, the frame members for the vehicle windows and doors are integrated into the respective body modules in the same manner as the support frame parts, whereby the cost of assembly in the area of the window and door cutouts is again greatly reduced, and with a view to further facilitation of fabrication, the cover layers are hemmed along the window and door frame members appropriately only after completion of the respective body modules, so that a prior precisely fitting cut of the cover layers at the window and door cutouts of the body is not necessary.

The cover layers preferably are fiber laminate layers which are bonded to the support frame parts areawise and, if the adhesive bond is to be strengthened locally, are appropriately riveted as well.

A prehardened fiber laminate may be used in the fabrication of the body modules at least as outer skin of a cover layer, whereby imprints of the support frame and other sandwich insert parts, e.g. of honeycomb core cuts, on the external and internal sides of the body modules, are effectively prevented and thus the vehicle is given a smooth surface both outside and inside, without requiring costly surface remachining, e.g. by grinding, or an additional inner lining installed subsequently.

BRIEF DESCRIPTION OF THE DRAWINGS

The invention will be described in greater detail in the following detailed description with reference to the drawings, in which:

FIG. 5 is a section through a fitting/plug-in connection in the sidewall/roof zone V of FIG. 1 before assembly; and FIGS. 6*a* and 6*b* are, respectively, perspective and sectional partial views of the window and door frame region along line VI—VI of FIG. 1.

DETAILED DESCRIPTION

Figure 1:
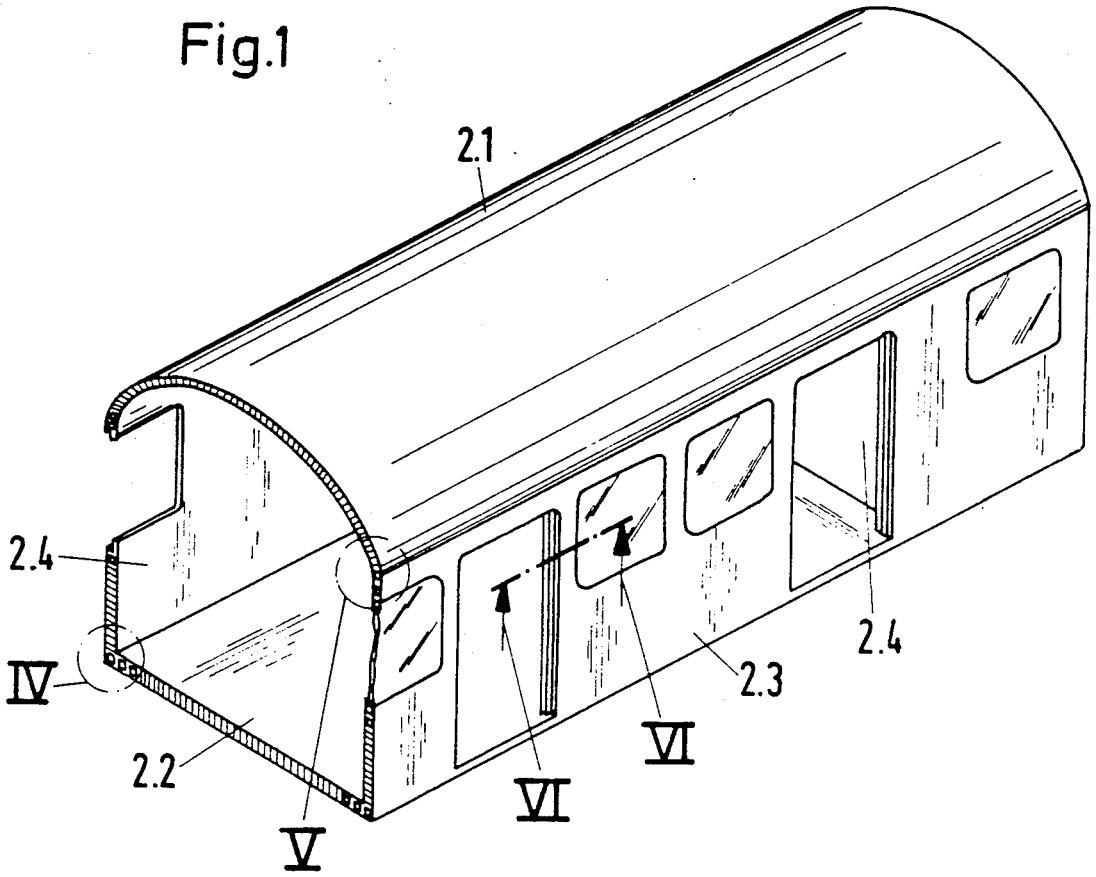
FIG. 1 is a perspective partial representation of a vehicle body according to the invention.

The rail vehicle body shown in FIG. 1 consists of individual prefabricated roof, bottom, end (not visible) and sidewall body modules 2.1 to 2.4, which in the assembled state form both the vehicle body support frame, composed in grid fashion of individual support frame parts, and the sandwich planking of the support frame for shear reinforcement.

Figure 2:
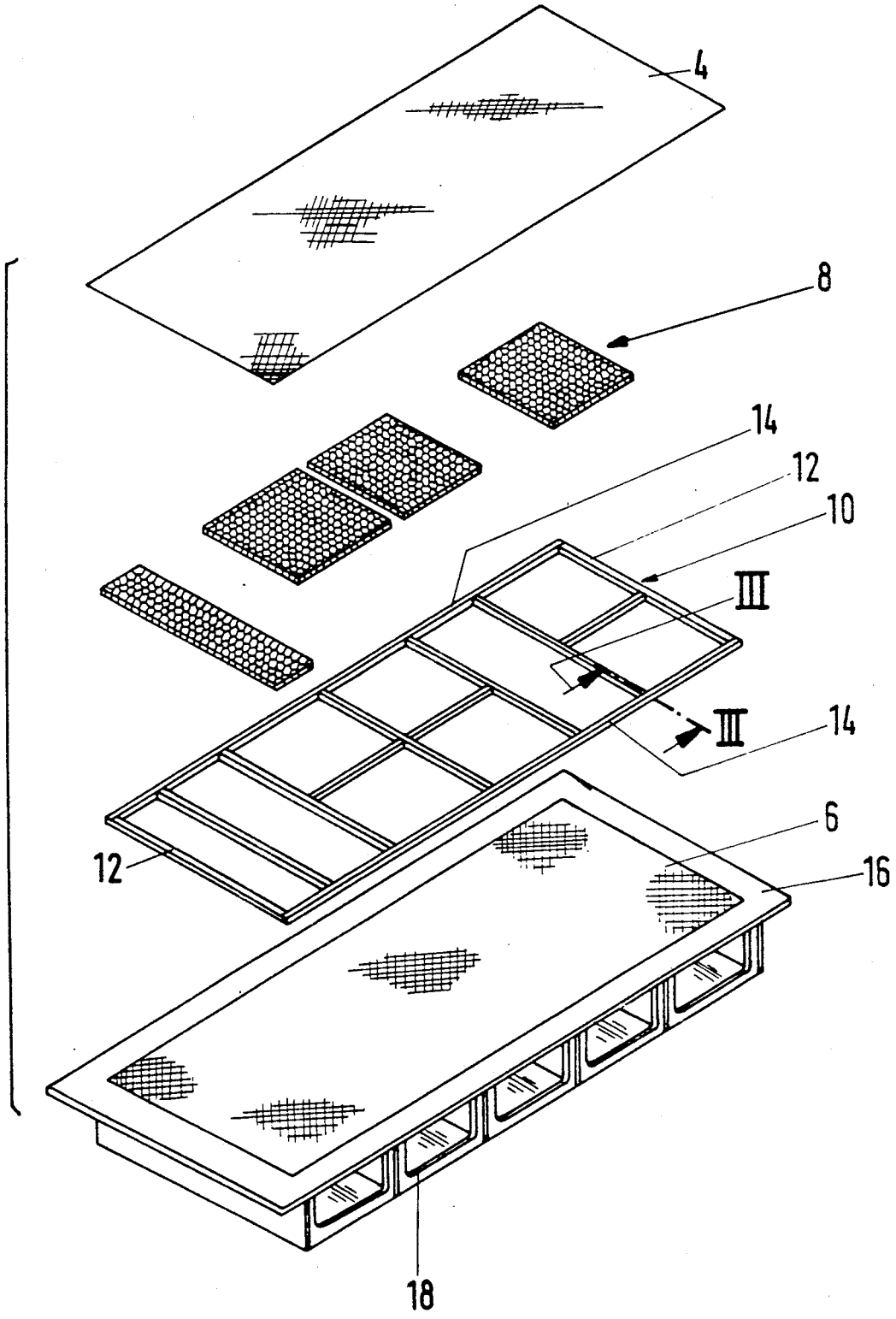
FIG. 2 shows the separate components of one of the body modules in perspective view.

The structure and fabrication of the body modules will be explained in connection with a sidewall submodule with reference to FIG. 2. The body module is designed as a sandwich structure with inner and outer cover layers 4, 6 of fiber laminate material, between which are bonded a honeycomb core supporting layer 8 and the support section or frame parts 10 of the support frame associated with the body module, as an integral part of the sandwich structure. The support frame parts 10 are arranged in grid fashion, in such a way that the outer transverse and longitudinal sections 12, 14 form a circumferentially closed edging for the sandwich structure.

For making the sidewall body module, a tray 16 of aluminum or steel sheet is used, which is set up in horizontal position by means of a propping means 18 and on which firstly the two cover layers 4 and 6 are produced each singly with a predominantly ±45′ fiber layer pattern and allowed to harden. After hardening, the tray-side outer faces of the cover layers 4, 6 have a very smooth surface structure, so that expensive surface remachining or inner vehicle lining applied subsequently on the outer face of the inner cover layer 4 can be dispensed with. The outer cover layer 6 lying on tray 16 is then coated with an adhesive layer, as for instance a phenolic resin film or a foil adhesive (not shown), whereupon the support frame parts 10 are placed on and any possibly needed inserts, e.g. power lead-in elements in the form of glass chip members (also not shown), are inserted in the interstices between these parts. The remaining areas—with the exception of the areas to be kept free for the window and door cutouts—are now filled with the honeycomb core material 18. For reasons of saving labor, this material is cut to size only roughly, and the resulting gaps between them and the support section parts 10 are filled with an equalizing material in the form of an equalizing adhesive or foam, whereupon the inner cover layer 4 is placed on, again with interposition of a foil adhesive or a phenolic resin layer, and all components are bonded together under pressure and heat to the finished body module.

Figure 3:
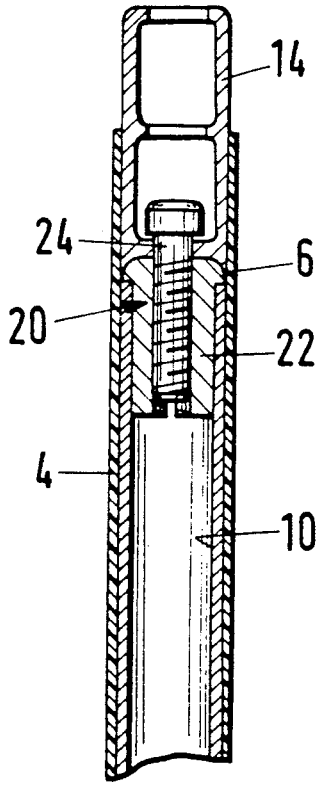
FIG. 3 is a section of an expansion bolt unit between two support frame parts within a body module along line III—III of FIG. 2.

The support frame parts 10 of each body module are prefabricated as hollow profiles of aluminum or fiber laminate and are firmly joined together with a view to exact positioning within the body module, already before they are incorporated in the sandwich structure, and this preferably by expansion bolt connections 20 as shown in FIG. 3 which consist of a dowel part 22, inserted into the open end of a support frame part 10, and of fastening screws 24 screwed into the dowel part 22, causing it to expand, and introduced through bores in the profile walls of the other support frame part 14.

The tray 16 is used also for the production of body modules which—like the roof modules 2.1—have a cross-section configuration curved one-dimensionally. For this purpose, the tray 16 is fixed, e.g. by appropriate templates, to the propping device 18 in the desired elastically deformed state, whereupon the curved body module is produced in the same manner as the above described flat body module, except that of course correspondingly pre-bent support frame parts 10 are needed.

Figure 4:
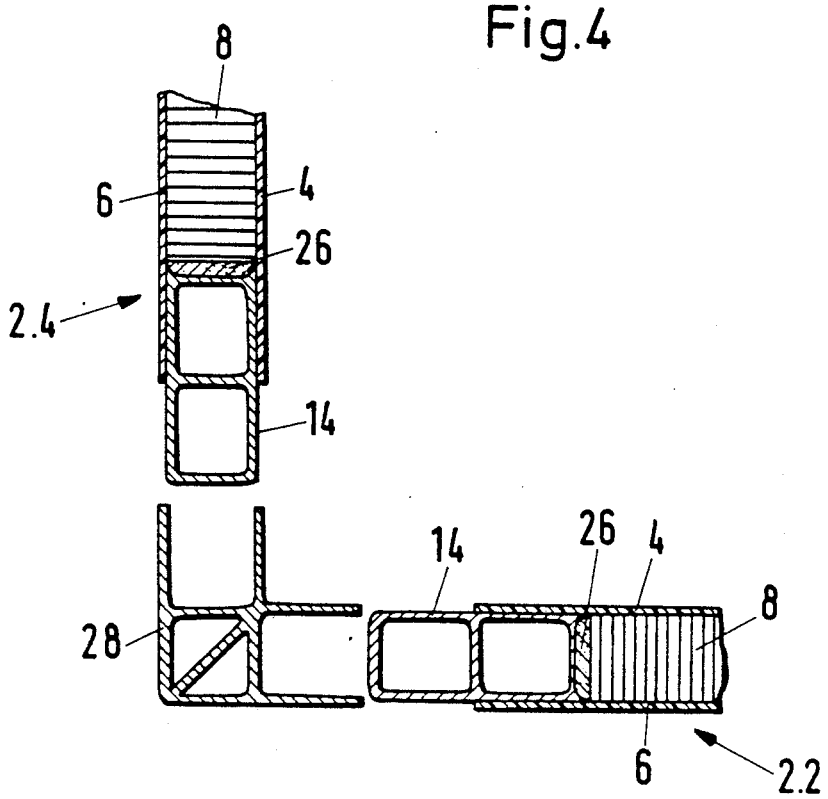
FIG. 4 is a section through a fitting/plug-in connection between two body modules in the corner zone IV of FIG. 1 before assembly.

The individual body modules are fitted together through precisely fitting plug-in connections extending on a large area over the entire outer circumference of the body modules. For this purpose the peripheral support frame parts 12 and 14 are bonded to the cover layers 4, 6 only over a part of their frame width and are coupled for load transmission to the peripheral support section part 12, 14 of the adjacent body module by their cover layer-free portions. In FIG. 4 such a fitting connection between a bottom and a sidewall module 2.2 and 2.4 is shown. The double-chamber support frame parts 14, which form the outer periphery of the body module contiguous to the honeycomb core 8 with interposition of the equalizing adhesive or foam 26, are incorporated in the associated sandwich structure approximately only over one half of their frame width and are firmly joined together by means of a plug-in connecting profile 28 which is slipped onto the cover layer-free hollow chamber frame portions and glued to it areawise, the free frame legs of the connecting profile 28, being flush with the cover layers 4, 6 of the body modules 2.2, 2.4 in the assembled state.

For the fitting connection between the roof and sidewall modules 2.1, 2.3 shown in FIG. 5, there is provided as the peripheral support frame part of the roof module 2.1 a hollow chamber profile 30 open on one side, the free legs 32 of which can be slipped onto the peripheral counter-frame member 14 of the sidewall module 2.3 with a tight fit when modules 2.1 and 2.3 are assembled together, so that the peripheral frame parts 14 and 30 can again be bonded together with exact mutual fixation of the respective body modules 2.1 and 2.3.

The described fitting connections, consisting of peripheral profile parts 12, 14, 30 to be telescoped in lateral direction with exact fit and then glued together, are used in analogous manner also between the other body modules, as for instance between the roof and end wall modules or for insertion of partition wall modules 2.4 (FIG. 1). In areas of local stress concentration, for which the strength of the gluing connection is not sufficient, the support frame parts 10 can be additionally riveted or screwed to the cover layers 4, 6 or—at the fitting connections between the body modules—to one another.

FIG. 5 shows further the possibility of designing the body module with a thickness different from the profile height of the peripheral support profile parts, in such a way that by inserting appropriate honeycomb core strips 8.2 a gradual transition from the sandwich thickness to the sectional height of the peripheral support profile part 14 is obtained in fabricating the body module.

In the same manner as the support profile parts 10, also the window and door frame members 34 and 36 are integrated into the sandwich structure 2, as shown in FIGS. 6*a* and 6*b*. At the corners of the window and door cutouts sighting radii are already formed at the frame members 34, 36., and excess cover layer material is removed by hemming or finishing to exact measure along the window and door frame edges after the bonding together of the sandwich structure 2. The window panes 38 are subsequently fastened to the frame 34 together with a rubber seal 40 and an edging 42. The door frame profile 36 contains an integrally formed portion 44 forming the door stop (FIG. 6*b*); alternatively the door frame profile 36 may be designed as divided into two parts—along the dashed dividing line in FIG. 6*b*—and the profile portion 44 fastened to the door frame section 36 after completion of the sidewall module 2.3.

According to a variant of fabrication of the body modules, prior hardening of the cover layers 4, 6 is dispensed with, and instead they are placed on the shaping tool 16, 18 together with the honeycomb core and support frame parts 8, 10 in the as yet unhardened state and then caused to harden with simultaneous bonding of the sandwich structure. In that case it is advisable, however, to cover the outer face of at least one, preferably the inner, cover layer 4 with a prehardened skin integrally bonded to the cover layer material during the hardening thereof.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A vehicle body, in particular for a rail vehicle, comprising a plurality of individually fabricated integral construction body modules each comprising a sandwich structure, the body modules comprising a support frame and sandwich parts attached to the support frame, said sandwich parts comprising an outer and an inner cover layer and a support layer cemented between the cover layers, the support frame comprising support frame parts inserted in the region of the support layer and secured to the cover layers, said support frame parts being provided at the outer periphery of the body modules with fitting connections for fitting the body modules together, said fitting connections comprising plug-in connecting elements adapted to be coupled together for transmission of load, said plug-in connecting elements comprising peripheral portions of the support frame parts bonded to the cover layers only over a part of their area and extending past the cover layers to form a cover layer free portion for receiving a mating fitting element of an adjoining body module, said mating fitting element being attached to one of an adjacent body module and an intermediate connecting element coupling two body modules.

2. The vehicle body recited in claim 1, wherein the individual body modules are completely enclosed at the outer periphery by the support frame parts provided with the fitting connections.

3. The vehicle body recited in claim 1, wherein the peripheral support frame parts comprise hollow section parts slidable one into the other with precise fit.

4. The vehicle body recited in claim 1, wherein the support frame parts are joined together within the individual body modules in grid fashion.

5. The vehicle body recited in claim 1, wherein the support frame parts are screwed together within the individual body modules.

6. The vehicle body recited in claim 1, wherein the supporting layer for the body modules comprise one of a honeycomb core and foam material fitted to the frame parts through an equalizing material.

7. The vehicle body recited in claim 1, wherein frame members for the vehicle windows and doors are integrated into the respective body modules.

8. The vehicle body recited in claim 7, wherein after completion of the respective body module the cover layers are hemmed along the window and door frame members.

9. The vehicle body recited in claim 1, wherein the cover layers comprise fiber laminate layers bonded areawise to the support frame parts.

10. The vehicle body recited in claim 9, wherein the cover layers are locally riveted to the support frame parts in addition to being bonded to the support frame parts.

11. The vehicle body recited in claim 10, wherein at least the outer skin of a cover layer is formed by a fiber laminate prehardened separately.

12. The vehicle body recited in claim 9, wherein at least the outer skin of a cover layer is formed by a fiber laminate prehardened separately.

13. A vehicle body, in particular for a rail vehicle, comprising a support frame including a plurality of support frame members secured to one another and sandwich parts, the sandwich parts being secured to said frame and comprising an outer and an inner cover layer and a support layer cemented between said cover layers, said sandwich parts being separately prefabricated to form individual body modules each including a sandwich part having the respective frame members integrally connected thereto, the frame members of each body module being disposed in the region of the support layer and secured to the cover layers of the body module, the support frame members of each body module being provided, at the outer periphery of the body module, with fitting connecting elements for fitting the frame members of adjoining body modules together to form said vehicle body.

* * * * *